US007955667B2

(12) United States Patent
Mcmanus et al.

(10) Patent No.: US 7,955,667 B2
(45) Date of Patent: Jun. 7, 2011

(54) INKJET RECORDING MEDIUM AND METHOD OF MAKING THE SAME

(75) Inventors: Richard J Mcmanus, San Diego, CA (US); Silke Courtenay, Temecula, CA (US); Sandeep Bangaru, San Diego, CA (US); Steven L Webb, Murrieta, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 923 days.

(21) Appl. No.: 11/686,591

(22) Filed: Mar. 15, 2007

(65) Prior Publication Data

US 2007/0235119 A1 Oct. 11, 2007

Related U.S. Application Data

(63) Continuation-in-part of application No. 11/398,786, filed on Apr. 6, 2006.

(51) Int. Cl.
*B41M 5/40* (2006.01)

(52) U.S. Cl. ..... 428/32.21; 428/32.24; 428/32.25; 428/32.34; 428/32.36; 428/206; 428/219; 428/331; 428/333; 428/341

(58) Field of Classification Search ..... 428/32.21, 428/32.24, 32.25, 32.34, 32.36, 206, 219, 428/331, 333, 341
See application file for complete search history.

(56) References Cited

U.S. PATENT DOCUMENTS

| | | | | |
|---|---|---|---|---|
| 4,792,487 | A | 12/1988 | Schubring et al. | |
| 5,605,750 | A | 2/1997 | Romano et al. | |
| 5,985,076 | A | 11/1999 | Misuda et al. | |
| 5,985,424 | A * | 11/1999 | DeMatte et al. | 428/212 |
| 6,187,430 | B1 * | 2/2001 | Mukoyoshi et al. | 428/331 |
| 6,231,720 | B1 | 5/2001 | Mouri et al. | |
| 6,685,999 | B2 | 2/2004 | Ichinose et al. | |
| 6,699,537 | B2 | 3/2004 | Branham et al. | |
| 2005/0249922 | A1 * | 11/2005 | Zhou et al. | 428/195.1 |
| 2006/0062941 | A1 | 3/2006 | Bi et al. | |

FOREIGN PATENT DOCUMENTS

| | | | |
|---|---|---|---|
| EP | 0 879 709 | A | 11/1998 |
| EP | 1 114 735 | A | 7/2001 |

* cited by examiner

*Primary Examiner* — Betelhem Shewareged

(57) ABSTRACT

An inkjet recording medium includes a substrate, a base layer, and a porous ink receiving layer. The base layer is established on at least one surface of the substrate, and the porous ink receiving layer is established on the base layer. The base layer includes calcined clay present in an amount ranging from about 25% to about 75% by dry weight.

22 Claims, 2 Drawing Sheets

INKJET RECORDING MEDIUM AND METHOD OF MAKING THE SAME

CROSS REFERENCE TO RELATED APPLICATION

This application is a continuation-in-part of U.S. patent application Ser. No. 11/398,786, filed on Apr. 6, 2006, which is incorporated by reference herein in its entirety.

BACKGROUND

The present disclosure relates generally to an inkjet recording medium and to methods of making the same.

Media suitable for use with inkjet printing often include one or more coating layers that are configured to enhance, for example, ink uptake, print performance, glossiness, or other properties. Some media coatings include ink receiving layers that are highly absorptive. Such layers may be capable of handling relatively large volumes of ink, however, their thickness may deleteriously affect inkjet performance. The combination of thick ink receiving layers and printed ink may, in some instances, result in bleed, coalescence, relatively poor color saturation and optical density, flooding and relatively poor drytime.

BRIEF DESCRIPTION OF THE DRAWINGS

Features and advantages of embodiments of the present disclosure will become apparent by reference to the following detailed description and drawings, in which like reference numerals correspond to similar, though not necessarily identical components. For the sake of brevity, reference numerals or features having a previously described function may not necessarily be described in connection with other drawings in which they appear.

DETAILED DESCRIPTION

Embodiments of the inkjet recording medium and system disclosed herein advantageously include relatively thin layers (i.e., base layer and ink receiving layer(s)). These layers advantageously have a lower coatweight than thick imaging layers (i.e., layers having a thickness greater than about 30 gsm). It is believed that the combination of the lower coatweights and the materials used to form the thin layers enhances inkjet performance. Enhanced inkjet performance may include increased color saturation, reduced bleed, reduced coalescence, reduced drytime, increased ink uptake, and combinations thereof.

It is to be understood that the terms "disposed on", "deposited on", "established on" and the like are broadly defined herein to encompass a variety of divergent layering arrangements and assembly techniques. These arrangements and techniques include, but are not limited to (1) the direct attachment of one material layer to another material layer with no intervening material layers therebetween; and (2) the attachment of one material layer to another material layer with one or more material layers therebetween, provided that the one layer being "disposed on", "deposited on", or "established on" the other layer is somehow "supported" by the other layer (notwithstanding the presence of one or more additional material layers therebetween). The phrases "directly deposited on", "deposited directly on" or "established directly on" and the like are broadly defined herein to encompass a situation(s) wherein a given material layer is secured to another material layer without any intervening material layers therebetween. Any statement used herein which indicates that one layer of material is on another layer is to be understood as involving a situation wherein the particular layer that is "on" the other layer in question is the outermost of the two layers relative to incoming ink materials being delivered by the printing system of interest. It is to be understood that the characterizations recited above are to be effective regardless of the orientation of the recording medium materials under consideration.

Figure 1:
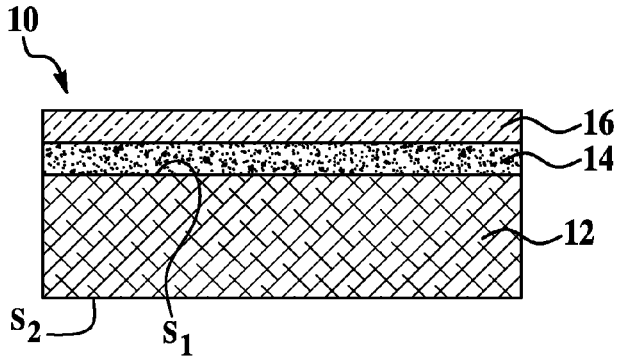
FIG. 1 is a schematic cross-sectional view of an embodiment of the inkjet recording medium having a base layer and a porous ink receiving layer.

Referring now to FIG. 1, an embodiment of the inkjet recording medium 10 includes a substrate 12, a base layer 14, and a porous ink receiving layer 16. The substrate 12 may be any cellulose-based paper, photobase paper (non-limitative examples of which include polyethylene or polypropylene extruded on one or both sides of paper), synthetic papers (a non-limitative example of which includes those manufactured by YUPO Corporation America, Chesapeake, Va.), or combinations thereof. The substrate 12 may be laminated/extruded with a substrate coating (shown as reference numeral 20 in FIG. 3). One non-limitative example of a suitable substrate coating 20 is an ink-impermeable coating layer, such as, for example, polyethylene. It is further contemplated that both sides of the substrate 12 may be coated with the substrate coating 20. In an embodiment, a layer of gelatin may further be deposited on the polyethylene ink-impermeable coating layer.

The base layer 14 is established on at least one surface $S_1$, $S_2$ of the substrate 12. In the embodiment shown in FIG. 1, the base layer 14 is established on one surface $S_1$. In another embodiment, the base layer 14 is established on both of the substrate surfaces $S_1$, $S_2$ (see FIG. 4). The base layer 14 may be established via any suitable process, including, but not limited to roll-coating, conventional slot-die processing, blade coating, slot-die cascade coating, curtain coating and/or other comparable methods including those that use circulating and non-circulating coating technologies. In some instances, spray-coating, immersion-coating, and/or cast-coating techniques may be suitable for establishing the base layer 14.

In an embodiment, the base layer 14 includes calcined clay (a pigment) present in an amount ranging from about 25% to about 75% by dry weight. In another embodiment, the calcined clay amount ranges from about 35% to about 60%, by dry weight. Without being bound to any theory, it is believed that the calcined clay provides an absorption characteristic to the base layer 14. In an embodiment, the calcined clay has an oil absorption according to ASTM D281-95 of greater than 100 grams of oil per 100 grams of pigment. Non-limiting examples of calcined clay include ANSILEX93, manufactured by Englehard Corp., Iselin, N.J., or NEOGEN 2000, manufactured by Imerys Pigments, Inc., Roswell, Ga.

The base layer 14 may also include other pigments. Examples of such pigments include, but are not limited to inorganic pigments (e.g., kaolin clay, calcium carbonate (e.g., precipitated calcium carbonate), aluminum trihydrate, titanium dioxide, or combinations thereof), polymeric or plastic pigments (e.g., polystyrene, polymethacrylates, polyacrylates, copolymers thereof, and/or combinations thereof), and/or combinations thereof. Non-limiting examples of plastic pigments include those that are commercially available from The Dow Chemical Company, Midland, Mich. (such as, 722HS, 756A and 788A lattices), and those that are commercially available from Rohm & Hass, Philadelphia, Pa. (such as ROPAQUE® HP-1055 and ROPAQUE® HP-543P). In an embodiment, the pigments are precipitated calcium carbonates, and in another embodiment, the pigments are calcium carbonates with an aragonite crystal structure and a high aspect ratio (non-limitative examples of which include OPACARB A-40, which is commercially available from Specialty Minerals Inc., Bethlehem, Pa. In still another embodiment, the pigment is an ultrafine kaolin clay having a median equivalent spherical diameter (esd) of less than about 650 nm, as determined by a Microtrac-UPA150 (available from Nikkiso Co., Ltd.) laser light scattering device).

In an embodiment, the inorganic pigments are present in the base layer 14 in an amount ranging from about 30% to about 60% by dry weight of the base layer 14. In another embodiment, the polymeric or plastic pigments are present in the base layer 14 in an amount ranging from about 1% to about 4% by dry weight.

A non-limiting example of the base layer 14 includes aragonite precipitated calcium carbonate with the calcined clay present in a ratio ranging from 3:7 to 7:3.

The base layer 14 may also include one or more binders. Non-limiting examples of such binders include poly(vinyl alcohol), polyvinylacetates, polyacrylates, polymethacrylates, polystyrene-butadiene, polyethylene-polyvinylacetate copolymers, starch, casein, gelatin, and/or copolymers thereof, and/or combinations thereof. Other additives, such as, for example, optical brighteners, defoamers, wetting agents, rheology modifiers, and/or the like, and/or combinations thereof may be added to the base layer 14.

Embodiments of the base layer 14 have a coatweight ranging from about 5 gsm to about 40 gsm. Other embodiments of the base layer 14 have a coatweight ranging from about 15 gsm to about 30 gsm; and still other embodiments of the base layer 14 have a coatweight ranging from about 18 gsm to about 25 gsm.

FIG. 1 also depicts the porous ink receiving layer 16 established on the base layer 14. In an embodiment, the porous ink receiving layer 16 includes silica, alumina, hydrous alumina (which includes but is not limited to boehmite and pseudoboehmite), calcium carbonate, and/or combinations thereof.

Generally, the porous ink receiving layer 16 has a coatweight ranging from about 2 gsm to about 30 gsm. Other embodiments of the porous ink receiving layer 16 have a coatweight ranging from about 3 gsm to about 10 gsm. It is to be understood that the porous ink receiving layer 16 may be established via any suitable deposition technique/manufacturing process, including, but not limited to roll-coating, conventional slot-die processing, blade coating, slot-die cascade coating, curtain coating and/or other comparable methods including those that use circulating and non-circulating coating technologies. In certain instances, spray-coating, immersion-coating, and/or cast-coating techniques may be suitable.

One non-limiting example of the porous ink receiving layer 16 includes treated silica or treated fumed silica. In an embodiment, the silica or fumed silica is treated with an inorganic treating agent and a monoaminoorganosilane treating agent. This type of treated layer is described in more detail in U.S. patent application Ser. No. 11/257,960, filed Oct. 24, 2005, which is incorporated by reference herein in its entirety. This treated silica porous ink receiving layer 16 has a coatweight ranging from about 3 gsm to about 15 gsm.

Another non-limiting example of the porous ink receiving layer 16 includes a combination of boehmite and a binder material (e.g., poly(vinyl alcohol, polyvinyl acetate, polyvinylacrylate, polyvinylacrylate esters, polyvinyl methacrylate, polyvinymethacrylate esters, mixtures and/or copolymers of the monomers used in the previously mention polymers, and/or combinations thereof). This embodiment of the porous ink receiving layer 16 has a coatweight ranging from about 0.5 gsm to about 30 gsm.

Figure 2:
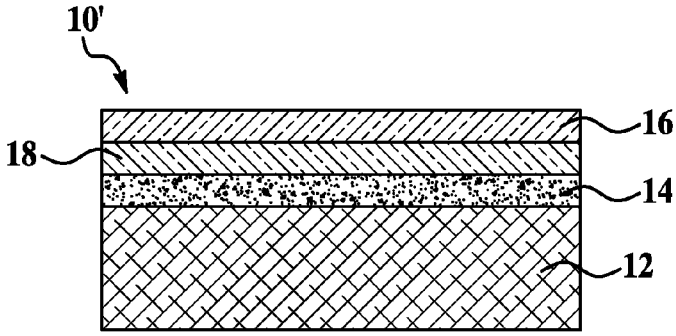
FIG. 2 is a schematic cross-sectional view of another embodiment of the inkjet recording medium having a base layer, an intermediate layer, and a porous ink receiving layer.

FIG. 2 depicts another embodiment of the inkjet recording medium 10'. In this embodiment, an intermediate layer 18 is established between the porous ink receiving layer 16 and the base layer 14. While a single intermediate layer 18 is shown in FIG. 2, it is to be understood that any number of intermediate layers 18 may be included between the porous ink receiving layer 16 and the base layer 14.

Generally, the one or more intermediate layer(s) 18 may include silica (e.g., fumed, precipitated, gel or colloidal silica), alumina, hydrous alumina, calcium carbonate, and/or combinations thereof. Embodiments of the intermediate layer (s) 18 have coatweights ranging from about 0 gsm to about 30 gsm; or more preferably between about 3 gsm and about 15 gsm. As a non-limiting example, the intermediate layer 18 includes silica (a non-limiting example of which includes the previously described treated silica), and has a coatweight ranging from about 5 gsm to about 10 gsm. In this example, the porous ink receiving layer 16 may include boehmite and have a coatweight less than or equal to about 4 gsm.

Figure 3:
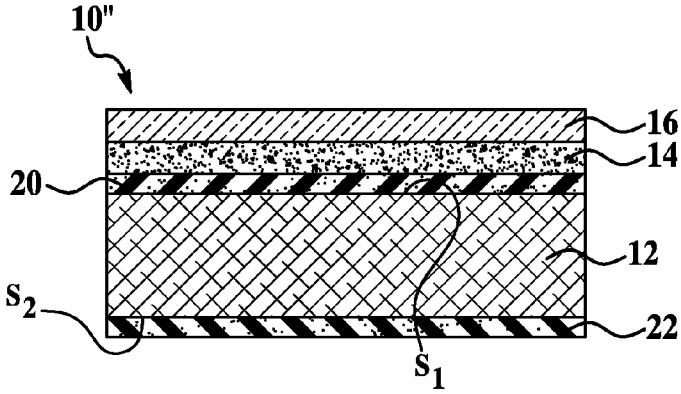
FIG. 3 is a schematic cross-sectional view of still another embodiment of the inkjet recording medium having a substrate coating and a backcoat.

Referring now to FIG. 3, another embodiment of the inkjet recording medium 10" is depicted. In this embodiment, the previously described substrate coating 20 is disposed between the substrate surface $S_1$ and the base layer 14. It is to be understood that the substrate coating 20 may also be established on the other substrate surface $S_2$. Non-limiting examples of the substrate coating 20 include the previously described ink impermeable materials (e.g., polyethylene), silica, alumina, calcined clay, calcium carbonate, kaolin clay, sodium silicates, calcium silicates and/or the like, and/or combinations thereof.

In the embodiment shown in FIG. 3, a backcoat 22 is established on the substrate surface $S_2$ that is opposed to the substrate surface $S_1$ having the substrate coating 20 established thereon. The backcoat 22 may be added to achieve reduced curling of the substrate 12, optimal picking performance (i.e., a single substrate 12 is easily removed from a stack of substrates 12, and optimal stacking performance. Non-limiting examples of materials suitable for forming the backcoat 22 include those materials suitable for the substrate coating 20.

Figure 4:
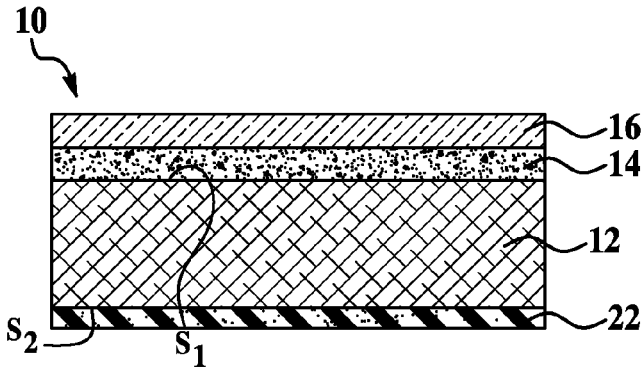
FIG. 4 is a schematic cross-sectional view of the embodiment of the inkjet recording medium shown in FIG. 1 with a backcoat.
Figure 5:
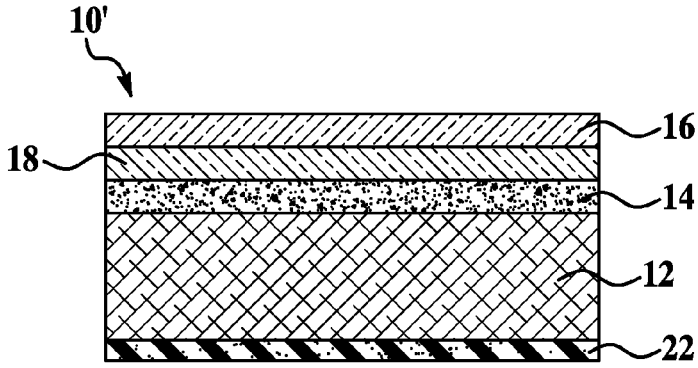
FIG. 5 is a schematic cross-sectional view of the embodiment of the inkjet recording medium shown in FIG. 2 with a backcoat.

FIGS. 4 and 5 depict the embodiments of the inkjet recording medium 10, 10' of FIGS. 1 and 2, respectively, having a backcoat 22 established thereon. As shown in the Figures, the backcoat 22 is established on the substrate surface $S_2$ that is opposed to the substrate surface $S_1$ having the base layer 14 established thereon. It is believed that the backcoat 22 improves curl and friction of the embodiment(s) of the inkjet recording medium 10, 10'.

Figure 6:
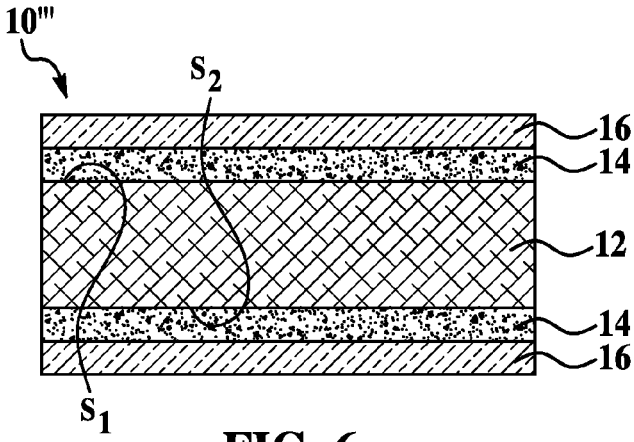
FIG. 6 is a schematic cross-sectional view of a further embodiment of the inkjet recording medium having base and porous ink receiving layers on both substrate surfaces.

FIG. 6 depicts still another embodiment of the inkjet recording medium 10'''. In this embodiment, base layers 14 are established on both substrate surface $S_1$, $S_2$, and porous inkjet receiving layers 16 are established on each of the base layers 14. It is to be understood that the materials, additional layers (18, 20, 22) and processes disclosed herein in reference to the other embodiments are suitable for forming the embodiment of the inkjet recording medium 10'''.

In any of the embodiments disclosed herein, the gloss of the inkjet recording medium 10, 10', 10'', 10''' may be obtained by calendering the entire medium 10, 10', 10'', 10''', by calendering the base layer 14 before establishing the porous ink receiving layer 16, or by calendering the intermediate layer 18 before establishing the ink receiving layer 16.

An embodiment of the inkjet recording system disclosed herein includes an embodiment of the inkjet recording medium 10, 10', 10'', 10''' and an inkjet ink configured to be established on the inkjet recording medium 10, 10', 10'', 10'''. In an embodiment of a method for using embodiment(s) of the inkjet ink system, the ink is established on at least a portion of the medium 10, 10', 10'', 10''' to form an image. The amount of the ink established depends, at least in part, on the desirable image to be formed. The image may include alphanumeric indicia, graphical indicia, or combinations thereof.

Non-limiting examples of suitable inkjet printing techniques include thermal inkjet printing, piezoelectric inkjet printing, or continuous inkjet printing. Suitable printers include portable thermal or piezoelectric inkjet printers (e.g., handheld printers, arm mountable printers, wrist mountable printers, etc.), desktop thermal or piezoelectric inkjet printers, continuous inkjet printers, or combinations thereof.

To further illustrate embodiment(s) of the present disclosure, an example is given herein. It is to be understood that this example is provided for illustrative purposes and is not to be construed as limiting the scope of the disclosed embodiment(s).

EXAMPLE

An embodiment of the inkjet recording medium disclosed herein was prepared with a base layer including 0.6% (dry weight) of a surfactant, 4.3% (dry weight) of plastic pigment, 51.2% (dry weight) of calcium carbonate, 34.1% (dry weight) of calcined clay, 9.4% (dry weight) of styrene-butadiene binder, and 0.4% (dry weight) of poly(vinyl alcohol). The coatweight of the base layer was about 20 gsm. A silica porous ink receiving layer (having a coatweight of about 7 gsm) was established on the base layer.

A comparative medium was prepared with a calcium carbonate base coat, and a silica porous ink receiving layer (coatweight ~7 gsm) established on the calcium carbonate base coat.

Ink was established on each of the embodiments of the medium disclosed herein (referred to as "medium") and the comparative medium (referred to as "comparative medium") using an inkjet printer. The bleed, optical density, and gamut were measured for each sample.

Eight different samples of the medium and the comparative medium were tested for bleed. Various color combinations were printed together, and the bleed was measured in milliliters. The maximum bleed for ink printed on the medium was about 5 ml, whereas the maximum bleed for ink printed on the comparative medium was about 9 ml. Half of the mediums had reduced bleed compared to the comparative medium, and three of the mediums had substantially the same bleed results as the comparative medium. These results indicate that the majority of the mediums tested exhibited either better or comparable bleed results as compared to the bleed on the comparative medium.

The results for optical density and gamut are shown in Tables 1 and 2, respectively.

TABLE 1

Optical Density

| Sample | Black Optical Density (K OD) |
|---|---|
| Medium | 2.3 |
| Medium | 2.3 |
| Medium | 2.3 |
| Comparative Medium | 1.72 |
| Comparative Medium | 1.73 |
| Comparative Medium | 1.73 |

As depicted in Table 1, the black optical density was greater on the medium than on the comparative medium. Without being bound to any theory, it is believed that these results are due, at least in part, to the specific combination of the base layer and the porous ink receiving layer of the embodiment(s) of the medium disclosed herein.

TABLE 2

Gamut Volume

| Sample | Gamut Volume |
|---|---|
| Medium | 410794 |
| Medium | 417383 |
| Medium | 416384 |
| Comparative Medium | 287854 |
| Comparative Medium | 292130 |
| Comparative Medium | 287551 |

As depicted in Table 2, the gamut volume of the ink was greater on the medium than on the comparative medium. Without being bound to any theory, it is believed that the gamut results are due, at least in part, to the specific combination of the base layer and the porous ink receiving layer of the embodiments of the medium disclosed herein.

While several embodiments have been described in detail, it will be apparent to those skilled in the art that the disclosed embodiments may be modified. Therefore, the foregoing description is to be considered exemplary rather than limiting.

What is claimed is:

1. An inkjet recording medium, comprising:

a substrate;

a base layer established on at least one surface of the substrate, the base layer including i) calcined clay present in an amount ranging from about 35% to about 60% by dry weight, ii) aragonite precipitated calcium carbonate, and iii) kaolin clay having a median equivalent spherical diameter of less than about 650; the base layer having a coatweight ranging from about 18 gsm to about 40 gsm; and a porous ink receiving layer established on the base layer.

2. The inkjet recording medium as defined in claim 1, further comprising at least one intermediate layer established between the base layer and the porous ink receiving layer.

3. The inkjet recording medium as defined in claim 2 wherein the at least one intermediate layer includes silica, alumina, hydrous alumina, calcium carbonate, or combinations thereof.

4. The inkjet recording medium as defined in claim 2 wherein the at least one intermediate layer includes fumed silica, and wherein the porous ink receiving layer includes boehmite or pseudo-boehmite.

5. The inkjet recording medium as defined in claim 4 wherein the fumed silica is treated with an inorganic treating agent and a monoaminoorganosilane treating agent.

6. The inkjet recording medium as defined in claim 1 wherein the base layer further includes a pigment selected from polymeric pigments, aluminum trihydrate, titanium dioxide, and combinations thereof.

7. The inkjet recording medium as defined in claim 6 wherein the base layer includes the aragonite precipitated calcium carbonate with the calcined clay present in a ratio ranging from 3:7 to 7:3.

8. The inkjet recording medium as defined in claim 1 wherein the substrate is selected from cellulose-based papers, synthetic papers, photobase papers, and combinations thereof.

9. The inkjet recording medium as defined in claim 1 wherein the porous ink receiving layer includes silica, alumina, hydrous alumina, calcium carbonate, or combinations thereof.

10. The inkjet recording medium as defined in claim 9 wherein the porous ink receiving layer includes silica treated with an inorganic treating agent and a monoaminoorganosilane treating agent.

11. The inkjet recording medium as defined in claim 10 wherein the silica is fumed silica.

12. The inkjet recording medium as defined in claim 1 wherein a coatweight of the porous ink receiving layer is up to about 30 gsm.

13. The inkjet recording medium as defined in claim 1 wherein a printed indicia is formed when an inkjet ink is established on the inkjet recording medium, and wherein the printed indicia or the inkjet recording medium exhibits a characteristic selected from enhanced color saturation, reduced bleed, reduced coalescence, reduced drytime, enhanced ink uptake, and combinations thereof.

14. The inkjet recording medium as defined in claim 1, further comprising a backcoat established on at least one other surface of the substrate, the at least one other surface being opposed to the at least one surface upon which the base layer is established.

15. A method of making an inkjet recording medium, comprising:

establishing a base layer on a substrate surface, the base layer including i) calcined clay present in an amount ranging from about 35% to about 60% by dry weight, ii) aragonite precipitated calcium carbonate, and iii) kaolin clay having a median equivalent spherical diameter of less than about 650 nm, and combinations thereof; the base layer having a coatweight ranging from about 18 gsm to about 40 gsm; and establishing a porous ink receiving layer on the base layer.

16. The method as defined in claim 15, further comprising establishing at least one intermediate layer on the base layer prior to establishing the porous ink receiving layer.

17. The method as defined in claim 15, further comprising providing an aqueous suspension that is used to form the base layer, the aqueous suspension including:

the calcined clay present in an amount ranging from about 35% to about 60% by dry weight; and a pigment selected from polymeric pigments, aluminum trihydrate, titanium dioxide, or combinations thereof.

18. An inkjet recording system, comprising: an inkjet recording medium, including:

a substrate;

a base layer established on at least one surface of the substrate, the base layer the base layer including i) calcined clay present in an amount ranging from about 35% to about 60% by dry weight, ii) aragonite precipitated calcium carbonate, and iii) kaolin clay having a median equivalent spherical diameter of less than about 650 nm, and combinations thereof; the base layer having a coatweight ranging from about 18 gsm to about 40 gsm; and a porous ink receiving layer established on the base layer, the porous ink receiving layer having a coatweight ranging from about 2 gsm to about 30 gsm; and an inkjet ink configured to be established on the inkjet recording medium.

19. The inkjet recording system as defined in claim 18 wherein the base layer further includes a pigment selected from, polymeric pigments, aluminum trihydrate, titanium dioxide, and combinations thereof; and wherein the porous ink receiving layer includes silica, alumina, hydrous alumina, calcium carbonate, or combinations thereof.

20. A method of using the system as defined in claim 18, the method comprising printing an effective amount of the inkjet ink on the inkjet recording medium, thereby forming a printed indicia.

21. The method as defined in claim 20 wherein printing is accomplished via thermal inkjet printing, piezoelectric inkjet printing, continuous inkjet printing, or combinations thereof.

22. The method as defined in claim 20 wherein the printed indicia or the inkjet recording medium exhibits a characteristic selected from enhanced color saturation, reduced bleed, reduced coalescence, reduced drytime, enhanced ink uptake, and combinations thereof.

* * * * *

UNITED STATES PATENT AND TRADEMARK OFFICE

CERTIFICATE OF CORRECTION

PATENT NO. : 7,955,667 B2
APPLICATION NO. : 11/686591
DATED : June 7, 2011
INVENTOR(S) : Richard J Mcmanus et al.

It is certified that error appears in the above-identified patent and that said Letters Patent is hereby corrected as shown below:

In column 6, line 61, in Claim 1, delete "650" and insert -- 650 nm --, therefor.

In column 8, line 4, in Claim 15, delete "650 nm, and combinations thereof" and insert -- 650 nm --, therefor.

In column 8, line 22, in Claim 18, after "layer" delete "the base layer".

In column 8, lines 26-27, in Claim 18, delete "650 nm, and combinations thereof" and insert -- 650 nm --, therefor.

In column 8, line 36, in Claim 19, delete "from," and insert -- from --.

Signed and Sealed this
Third Day of July, 2012

David J. Kappos

David J. Kappos
*Director of the United States Patent and Trademark Office*